US009863075B2

(12) United States Patent
Poy

(10) Patent No.: US 9,863,075 B2
(45) Date of Patent: Jan. 9, 2018

(54) CONTINUOUS BATCH TUNNEL WASHER AND METHOD

(71) Applicant: PELLERIN MILNOR CORPORATION, Kenner, LA (US)

(72) Inventor: Russell H. Poy, New Orleans, LA (US)

(73) Assignee: PELLERIN MILNOR CORPORATION, Kenner, LA (US)

( * ) Notice: Subject to any disclaimer, the term of this patent is extended or adjusted under 35 U.S.C. 154(b) by 0 days.

(21) Appl. No.: 14/873,781

(22) Filed: Oct. 2, 2015

(65) Prior Publication Data

US 2016/0097147 A1 Apr. 7, 2016

Related U.S. Application Data

(60) Provisional application No. 62/102,279, filed on Jan. 12, 2015, provisional application No. 62/059,212, filed on Oct. 3, 2014.

(51) Int. Cl.
*D06F 31/00* (2006.01)

(52) U.S. Cl.
CPC ..... *D06F 31/005* (2013.01); *D06F 31/00* (2013.01); *D06F 2232/00* (2013.01)

(58) Field of Classification Search
CPC ..... D06F 31/00; D06F 31/005; D06F 2232/00
USPC ..... 8/158, 159; 68/27, 143, 207
See application file for complete search history.

(56) References Cited

U.S. PATENT DOCUMENTS 1,686,313 A 10/1928 Dreher et al.
2,647,388 A 8/1953 Scheele
3,722,233 A 3/1973 Windhorst
4,236,393 A 12/1980 Katzfey
4,363,090 A 12/1982 Garcia
4,479,370 A 10/1984 Wang
4,485,509 A 12/1984 Pellerin et al.
4,522,046 A 6/1985 Dreher
(Continued)

FOREIGN PATENT DOCUMENTS

CN 1553973 12/2004
JP 04-102990 9/1992
(Continued)

OTHER PUBLICATIONS

PCT International Search Report and Written Opinion of the International Searching Authority, PCT/US2015/053739, dated Feb. 2, 2016.

*Primary Examiner* — Levon J Shahinian
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A method of washing fabric articles in a tunnel washer that includes moving the fabric articles from the intake of the washer to the discharge of the washer and through multiple modules or sectors. Liquid can be counter flowed in the washer interior along a flow path that is generally opposite the direction of travel of the fabric articles. A dual use zone includes multiple of the modules or sectors. In a dual use zone, a module or modules can be used to both wash and thereafter rinse the fabric articles. While counterflow rinsing, the flow rate can be maintained at a selected flow rate or flow pressure head. One or more booster pumps can optionally be employed to maintain constant counterflow rinsing flow rate or constant counterflow rinsing pressure head. During rinsing, extracted water or reuse water is first used to rinse followed by a clean water rinse.

6 Claims, 3 Drawing Sheets

(56) References Cited

U.S. PATENT DOCUMENTS

| | | | |
|---|---|---|---|
| 4,546,511 | A | 10/1985 | Kaufmann |
| 4,607,509 | A | 8/1986 | Stoll |
| 5,211,039 | A | 5/1993 | Pellerin |
| 5,392,480 | A | 2/1995 | Ishihara et al. |
| 5,454,237 | A | 10/1995 | Pellerin |
| 7,971,302 | B2 | 7/2011 | Poy et al. |
| 8,166,670 | B2 | 5/2012 | Poy |
| 8,336,144 | B2 | 12/2012 | Poy et al. |
| 8,365,435 | B2 | 2/2013 | Poy et al. |
| 8,370,981 | B2 | 2/2013 | Poy et al. |
| 8,689,463 | B2 | 4/2014 | Poy |
| 9,127,389 | B2 | 9/2015 | Poy et al. |
| 2002/0116770 | A1 | 8/2002 | Mehrmann et al. |
| 2003/0110576 | A1 | 6/2003 | ten Have |
| 2003/0110815 | A1 | 6/2003 | Poy |
| 2005/0257576 | A1 | 11/2005 | Omura et al. |
| 2009/0249560 | A1 | 10/2009 | Gaulter et al. |
| 2009/0255145 | A1 | 10/2009 | Poy |
| 2009/0260161 | A1 | 10/2009 | Poy et al. |
| 2009/0260162 | A1 | 10/2009 | Poy et al. |
| 2010/0146711 | A1 | 6/2010 | Bringewatt et al. |
| 2010/0313440 | A1 | 12/2010 | Poy et al. |
| 2011/0173761 | A1 | 7/2011 | Bringewatt et al. |
| 2011/0209292 | A1 | 9/2011 | Poy |
| 2011/0225741 | A1 | 9/2011 | Poy et al. |
| 2011/0283557 | A1 | 11/2011 | Poy |
| 2011/0296626 | A1 | 12/2011 | Poy |
| 2012/0023680 | A1 | 2/2012 | Poy et al. |
| 2012/0060564 | A1 | 3/2012 | Bringewatt et al. |
| 2012/0304487 | A1 | 12/2012 | Poy |
| 2013/0025151 | A1 | 1/2013 | Poy et al. |
| 2013/0213244 | A1 | 8/2013 | Poy et al. |
| 2013/0291314 | A1 | 11/2013 | Poy et al. |
| 2014/0053343 | A1 | 2/2014 | Poy |
| 2014/0053344 | A1 | 2/2014 | Poy |
| 2014/0216111 | A1 | 8/2014 | Bringewatt et al. |
| 2015/0167221 | A1 | 6/2015 | Poy |

FOREIGN PATENT DOCUMENTS

| | | |
|---|---|---|
| JP | 07-000674 | 1/1995 |
| JP | 09-253383 | 9/1997 |
| JP | 2001-038372 | 2/2001 |
| JP | 2001-137590 | 5/2001 |
| JP | 2003-033597 | 2/2003 |
| JP | 2004-538112 | 12/2004 |
| JP | 2006-141786 | 6/2006 |
| WO | 2003/016608 | 2/2003 |
| WO | 2009/129362 | 10/2009 |
| WO | 2010/124076 | 10/2010 |
| WO | 2010/144715 | 12/2010 |
| WO | 2011/109371 | 9/2011 |
| WO | 2011/153398 | 12/2011 |
| WO | 2012/009360 | 1/2012 |
| WO | 2013/016103 | 1/2013 |
| WO | 2014/031625 | 2/2014 |
| WO | 2014/031757 | 2/2014 |
| WO | 2015/095179 | 6/2015 |

CONTINUOUS BATCH TUNNEL WASHER AND METHOD

CROSS-REFERENCE TO RELATED APPLICATIONS

This application claims benefit of U.S. Provisional Patent Application Ser. No. 62/102,279, filed 12 Jan. 2015; and U.S. Provisional Patent Application Ser. No. 62/059,212, filed 3 Oct. 2014, which are hereby incorporated herein by reference and priority of each is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to continuous batch washers or tunnel washers. More particularly, the present invention relates to an improved method of washing textiles or fabric articles (e.g., clothing, linen) in a continuous batch multiple module tunnel washer wherein the textiles are moved sequentially from one module to the next module. A counter flowing rinse is boosted (e.g., using pumps) to elevate and/or maintain a selected flow rate or flow pressure head. Even more particularly, the present invention relates to a method and apparatus for washing fabric articles in a continuous batch tunnel washer using an improved flow arrangement wherein the pressure head is boosted at selected modules of the multiple modules of the continuous batch tunnel washer using one or more booster pumps that maintain substantially constant pressure of the rinse liquid that is counter flowed. Multiple dual use modules can be employed which provide faster rinsing with high velocity counterflow, more through put with less water usage by recycling water. After a final module, fabric articles can be transferred to a liquid extraction device (e.g., press or centrifuge) that removes excess water.

2. General Background of the Invention

Currently, washing in a commercial environment is generally conducted with a continuous batch tunnel washer. Such continuous batch tunnel washers are known (e.g., U.S. Pat. No. 5,454,237) and are commercially available (www.milnor.com). Continuous batch washers have multiple sectors, zones, stages, or modules including pre-wash, wash, rinse and finishing zone.

Commercial continuous batch washing machines in some cases utilize a constant counterflow of liquor. Such machines are followed by a centrifugal extractor or mechanical press for removing most of the liquor from the goods before the goods are dried. Some machines carry the liquor with the goods throughout the particular zone or zones.

When a counterflow is used in the prior art, there is counterflow during the entire time that the fabric articles or textiles are in the main wash module zone. This practice dilutes the washing chemical and reduces its effectiveness.

A final rinse with a continuous batch washer has been performed using a centrifugal extractor or mechanical press. In prior art systems, if a centrifugal extractor is used, it is typically necessary to rotate the extractor at a first low speed that is designed to remove soil laden water before a final extract.

Patents have issued that are directed to batch washers or tunnel washers. The following table provides examples of such patented tunnel washers, each listed patent of the following table being hereby incorporated herein by reference.

TABLE

| PATENT NO. | TITLE | ISSUE DATE |
|---|---|---|
| 4,236,393 | Continuous tunnel batch washer | 2 Dec. 1980 |
| 4,485,509 | Continuous batch type washing machine and method for operating same | 4 Dec. 1984 |
| 4,522,046 | Continuous batch laundry system | 11 Jun. 1985 |
| 5,211,039 | Continuous batch type washing machine | 18 May 1993 |
| 5,454,237 | Continuous batch type washing machine | 3 Oct. 1995 |
| US20110296626 | Continuous batch tunnel washer and method | 8 Dec. 2011 |
| WO2011/153398 | Continuous batch tunnel washer and method | 8 Dec. 2011 |
| WO 2015/095179 | Floor Mat And Particulate Laden Material Washing Apparatus And Method | 25 Jun. 2015 |
| US 2015/0167221 | Floor Mat And Particulate Laden Material Washing Apparatus And Method | 18 Jun. 2015 |
| 8,689,463 | Clothes Dryer Apparatus With Improved Lint Removal System | 8 Apr. 2014 |
| WO 2014/031757 | Washer Extractor Apparatus And Method | 27 Feb. 2014 |
| US 2014/0053344 | Washer Extractor Apparatus And Method | 27 Feb. 2014 |
| US 2014/0053343 | Continuous Batch Tunnel Washer And Method | 27 Feb. 2014 |
| WO 2014/031625 | Continuous Batch Tunnel Washer And Method | 27 Feb. 2014 |
| US 2013/0291314 | Continuous Batch Tunnel Washer And Method | 7 Nov. 2013 |
| US 2013/0213244 | Laundry Press Apparatus And Method | 22 Aug. 2013 |
| 8,370,981 | Integrated Continuous Batch Tunnel Washer | 12 Feb. 2013 |
| 8,365,435 | Laundry Press Apparatus And Method | 5 Feb. 2013 |
| WO 2013/016103 | Laundry Press Apparatus And Method | 31 Jan. 2013 |
| US 2013/0025151 | Laundry Press Apparatus And Method | 31 Jan. 2013 |
| 8,336,144 | Continuous Batch Tunnel Washer And Method | 25 Dec. 2012 |
| US 2012/0304487 | Clothes Dryer Apparatus With Improved Lint Removal System | 6 Dec. 2012 |
| 8,166,670 | Clothes Dryer Apparatus With Improved Lint Removal System | 1 May 2012 |
| US 2012/0023680 | Integrated Continuous Batch Tunnel Washer | 2 Feb. 2012 |
| WO 2012/009360 | Modulated Air Flow Clothes Dryer And Method | 19 Jan. 2012 |
| US 2011/0283557 | Modulated Air Flow Clothes Dryer And Method | 24 Nov. 2011 |
| US 2011/0225741 | Continuous Batch Tunnel Washer And Method | 22 Sep. 2011 |
| WO 2011/109371 | Washer Extractor And Method | 9 Sep. 2011 |
| US 2011/0209292 | Washer Extractor And Method | 1 Sep. 2011 |
| 7,971,302 | Integrated Continuous Batch Tunnel Washer | 5 Jul. 2011 |
| US 2010/0313440 | Laundry Press Apparatus And Method | 16 Dec. 2010 |
| WO 2010/144715 | Laundry Press Apparatus And Method | 16 Dec. 2010 |
| WO 2010/124076 | Continuous Batch Tunnel Washer And Method | 28 Oct. 2010 |
| WO 2009/129362 | Continuous Batch Tunnel Washer And Method | 22 Oct. 2009 |

TABLE-continued

| PATENT NO. | TITLE | ISSUE DATE |
|---|---|---|
| US 2009/0260161 | Integrated Continuous Batch Tunnel Washer | 22 Oct. 2009 |
| US 2009/0260162 | Continuous Batch Tunnel Washer And Method | 22 Oct. 2009 |
| US 2009/0255145 | Clothes Dryer Apparatus With Improved Lint Removal System | 15 Oct. 2009 |
| CN 1553973 | Continuous Tunnel Batch Washer Apparatus | 8 Dec. 2004 |
| EP 1425455 | Continuous Tunnel Batch Washer Apparatus | 9 Jun. 2004 |
| US 2003/0110815 | Continuous Tunnel Batch Washer Apparatus | 19 Jun. 2003 |
| WO 2003/016608 | Continuous Tunnel Batch Washer Apparatus | 27 Feb. 2003 |

BRIEF SUMMARY OF THE INVENTION

The present invention provides an improved method of washing fabric articles in a continuous batch tunnel washer. Embodiments of the method include providing a continuous batch tunnel washer having an interior, an intake, a discharge, a plurality of modules, and a volume of liquid.

Embodiments of the method of the present invention provide a counterflow (or counter flow) of liquid in the washer interior during rinsing including some interrupted counterflow. The counterflow is along a path that is generally opposite the direction of travel of the fabric articles. Booster pumps can be placed at intervals to increase the pressure and/or velocity of counter flowing rinse water. For example, in a twelve (12) module continuous batch washer there can be booster pumps placed at the fourth and eighth modules.

At a final module, the fabric articles are transferred via the discharge to a water extraction device or extractor (e.g., press or centrifuge). The extractor is used to remove excess water from the fabric articles after they have been discharged from the continuous batch tunnel washer.

For the greatest part of each cycle, processing without counterflow creates standing baths so that chemicals are allowed to do their job without being diluted. Then, for a very short portion of each cycle, high-velocity counterflow is applied, thus providing the first part of the required dilution effect. A second stage of dilution ensures the goods move into far cleaner water every time. Dedicated rinse modules are not required, meaning more production from fewer modules.

The counterflow is stopped for about the first 65-75% of each transfer cycle. The entire amount of counterflow water is then pumped at a very fast rate in the final 25-35% of the time remaining. The pumps are preferably high-volume, variable speed inverter-driven so that both flow rate and duration of the counter-flowing water can be fully varied based on goods being processed. The high speed flow gives better rinsing action and uses far less water.

Washers of the present invention achieve very low fresh water consumption. For light soil linen, the water consumption is about 0.3 gallons per pound (2.5 liters per kilogram) of linen processed. For most heavy soil linen, the expected water consumption is about 0.5 gallons per pound (4 liters per kilogram).

The method and apparatus of the present invention saves water with these features:

1) Interrupted Counterflow—Water only flows for rinsing which is about the last 25-35% of each cycle;

2) Controlled Flow—Water is delivered by high-volume inverter pumps with vigorous flow that removes suspended soil and uses chemistry faster, with less water;

3) Dual-Use Modules—Each module is used for both standing bath washing and counterflow rinsing; and 4) Full Water Availability—Fresh water and recycled press water are collected in a single tank mounted within the washer frame (e.g., under the load scoop). No external tanks are required.

The present invention is able to achieve maximum chemical performance with standing bath washing and high-velocity counterflow rinsing. High-speed water recirculation within the first module allows fast sluicing and wet-down, causing the chemistry to instantly penetrate the soiled linen.

After the transfer of the goods, the counterflow is interrupted creating a standing bath with no water flow so that chemistry is not diluted. Chemicals work at full concentration from the start of each bath. Chemicals work faster because of the large cylinder volume and fast intermixing with the goods.

Programmable high-volume pumps create a vigorous flow to remove exhausted chemistry and suspended soil effectively. Fixed partitions between each module prevent chemical mixing and leakage. No seals are required between modules.

Flow is paused at the start of each cycle to create standing baths without dilution so that chemicals work faster. Counterflow water is pumped at high volume for the very last portion of the cycle. Vigorous flow removes contaminants from fabric articles or linen much more quickly, thus reducing overall cleaning time. All wash modules are used for two functions: 1) standing bath and 2) high-speed counterflow for faster, better rinsing. Because of the dual-use modules, fewer modules are required. Rinsing occurs immediately after chemical action in each wash module. No separate rinse modules are required. Water and chemistry recirculate at high-velocity within the first module. Goods are sluiced faster and more completely into the machine. Wet-down of the fabric articles to be washed is almost instantaneous. Chemistry penetrates the fabric articles or linen instantly which is important for protein stains. The first module can thus be a working module.

The present invention requires fewer modules because of faster rinsing with high-velocity counterflow, more throughput with dual-use modules, and less water usage by recycling water.

The present invention includes a method of washing fabric articles in a continuous batch tunnel washer. The method includes providing a continuous batch tunnel washer having an interior, an intake, a discharge, a plurality of modules, and a volume of liquid. The fabric articles are moved from the intake to the modules and then to the discharge in sequence. In the step of moving the fabric articles, multiple of the modules define a dual use zone having dual use modules that function as both wash modules and rinse modules and adding a washing chemical to the volume of liquid in the dual use zone. After a selected time period, a rinsing liquid counterflows in the dual use zone along a flow path that is generally opposite the direction of travel of the fabric articles. During the step of counter flowing, pressure of the counter flowing rinsing liquid can be boosted with a pump at one or more positions spaced in between the intake and the discharge.

In the step of boosting pressure, multiple booster pumps can be provided, each pump boosting counter flowing rinsing liquid flow rate at a different one of the modules.

During the step of counter flowing, the counter flow can be at a flow rate of between about 20 and 300 gallons (76-1,136 liters) per minute.

In one embodiment, during the step of counter flowing, the counter flow is at a flow rate of between about 25 and 220 gallons (95-833 liters) per minute. In one embodiment, during the step of counter flowing, the counter flow is at a flow rate of between about 35 and 105 gallons (132-397 liters) per minute.

In one embodiment, the booster pumps are spaced apart by more than one module.

In one embodiment, the booster pump discharges liquid into a module that is a dual use module wherein textile articles are both washed and rinsed.

In one embodiment, the booster pumps each discharge liquid into a module that is a dual use module wherein textile articles are both washed and rinsed.

In one embodiment, liquid flow in the dual use module is substantially halted for a time period that is less than about five minutes.

In one embodiment, liquid flow in the dual use zone is substantially halted for a time period that is less than about three minutes.

In one embodiment, liquid flow in the dual use zone is substantially halted for a time period that is less than about two minutes.

In one embodiment, liquid flow in the dual use zone is substantially halted for a time period that is between about twenty and one hundred twenty (20-120) seconds.

In one embodiment, a volume of liquid in a plurality of the modules is heated to a temperature of between about 100 and 190 degrees Fahrenheit (38-88 degrees Celsius).

In one embodiment, the counter flow during the step of counter flowing extends through multiple of the modules.

In one embodiment, the dual use zone includes multiple modules.

In one embodiment, each booster pump discharges counter flowing fluid into a module that is not a module closest to the discharge.

The present invention includes a method of washing fabric articles in a continuous batch tunnel washer, comprising the steps of providing a continuous batch tunnel washer having an interior, an intake, a discharge, and a plurality of modules that segment the interior, wherein multiple of the modules define a dual use zone having modules that each function as both wash and rinse modules, moving the fabric articles from the intake to the discharge, adding a washing chemical to the dual use zone wherein modules in the dual use zone wash the fabric articles with a combination of water and said washing chemical, after a selected time interval and after the step of adding a washing chemical, counter flowing liquid in the washer interior along a flow path that is generally opposite the direction of travel of the fabric articles in the step of moving the articles, and counter flowing water through the modules of said dual use zone to effect a rinse of the fabric articles.

In one embodiment, the present invention further comprises boosting the flow rate in the step of counter flowing so that it is maintained at a desired value.

In one embodiment, multiple booster pumps are employed in order to boost the flow rate.

In one embodiment, there are a plurality of modules in between the booster pumps.

The present invention includes a method of washing fabric articles in a continuous batch tunnel washer, comprising the steps of providing a continuous batch tunnel washer having an interior, an intake, a discharge, a plurality of modules that segment the interior, and wherein a plurality of said modules define a dual use zone, moving the fabric articles from the intake to the discharge and through the modules in sequence, the fabric articles traversing the dual use zone during the step of moving the fabric articles from the intake to the discharge, adding a washing chemical to the dual use zone, and rinsing the fabric articles in the dual use zone by counter flowing liquid in the washer interior along a flow path that is generally opposite the direction of travel of the fabric articles in prior steps.

In one embodiment, the present invention further comprises extracting excess fluid from the fabric articles after the step of rinsing the fabric articles.

In one embodiment, there is substantially no counterflow during the step of adding a washing chemical to the dual use zone and for a time period after this step.

In one embodiment, the time period is less than about five minutes.

The present invention includes a method of washing fabric articles in a continuous batch tunnel washer, comprising the steps of providing a continuous batch tunnel washer having an interior, an intake, a discharge, and a plurality of modules that segment the interior, the interior including at least one dual use zone that includes multiple of said modules that each function as both a wash module and a rinse module, moving the fabric articles and a volume of liquid in a first direction of travel from the intake to the discharge and through the dual use zone, washing the fabric articles with a chemical bath in the dual use zone, and rinsing the fabric articles by counter flowing a rinse liquid in the dual use zone along a second flow path that is generally opposite the first direction of travel of the fabric articles in the step of moving the fabric articles.

In one embodiment, the present invention further comprises the step of boosting the flow pressure head of the counter flowing liquid in the step of rinsing the fabric articles by counter flowing at one or more modules.

In one embodiment, in the step of rinsing the fabric articles by counter flowing, the counter flow has a duration of between about 2 and 6 minutes.

In one embodiment, the counter flow is at a flow rate of between about 20 and 300 gallons (76-1,136 liters) per minute.

In one embodiment, the counter flow is at a flow rate of between about 25 and 220 gallons (95-833 liters) per minute.

In one embodiment, the counter flow is at a flow rate of between about 35 and 105 gallons (132-397 liters) per minute.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
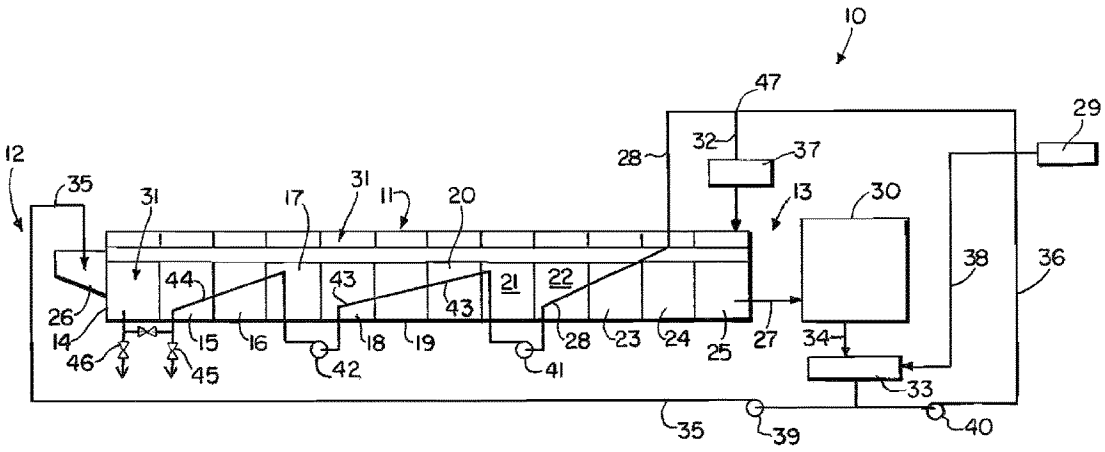
FIG. 1 is a schematic diagram showing a first embodiment of the apparatus of the present invention.

FIG. 1 shows a schematic diagram of the textile washing apparatus of the present invention, designated generally by the numeral 10. Textile washing apparatus 10 provides a tunnel washer 11 having an inlet end portion 12 and an outlet end portion 13. In FIG. 1, tunnel washer 11 provides a number of modules 14-25. The plurality of modules 14-25 can include modules which can be dual use modules in that the dual use modules function as both main wash and rinse modules. The total number of modules 14-25 can be more or less than the number of modules shown in FIGS. 1-2.

Inlet end portion 12 can provide a hopper 26 that enables the intake of textiles or fabric articles to be washed. Such fabric articles, textiles, and goods to be washed can include clothing, linens, towels, and the like. An water extractor device 30 can be positioned next to the outlet end portion 13 of tunnel washer 11. Flow lines are provided for adding water and/or chemicals (e.g., cleaning chemicals, detergent, etc.) to tunnel washer 11.

When the fabric articles, goods and/or linens are initially transferred into modules 14-25, an interrupted counterflow for a part of the batch transfer time is used. By using this interrupted counterflow for part (e.g., between about fifty and ninety percent (50-90%), preferably about seventy-five percent (75%)) of the batch transfer time, each module 14-25 performs as a separate batch. Batch transfer time can be defined as the time that the fabric articles/linens remain in a module before transfer to the next successive module.

By halting counterflow when some of the modules are functioning as main wash modules, this creates essentially a standing bath for the washing process and allows the cleaning chemicals to perform their function fully without any dilution from a counterflow of fluid within the tunnel washer 11. Counterflow returns for the last part (e.g., last 25%) of the transfer time and is pumped at a higher rate (e.g., between about three hundred and four hundred percent (300%-400%)) of the normal rate. This higher rate is thus higher than the flow rate of prior art machines using full time counterflow. For example, prior art machines with full time counterflow typically employ a flow rate of between about ten and thirty (10-30) gallons (38-114 liters) per minute and create a full rinsing hydraulic head. The present invention eliminates the need to have additional modules dedicated to the function of rinsing and finishing as required in the prior art, thus saving cost and floor space.

Figure 2:
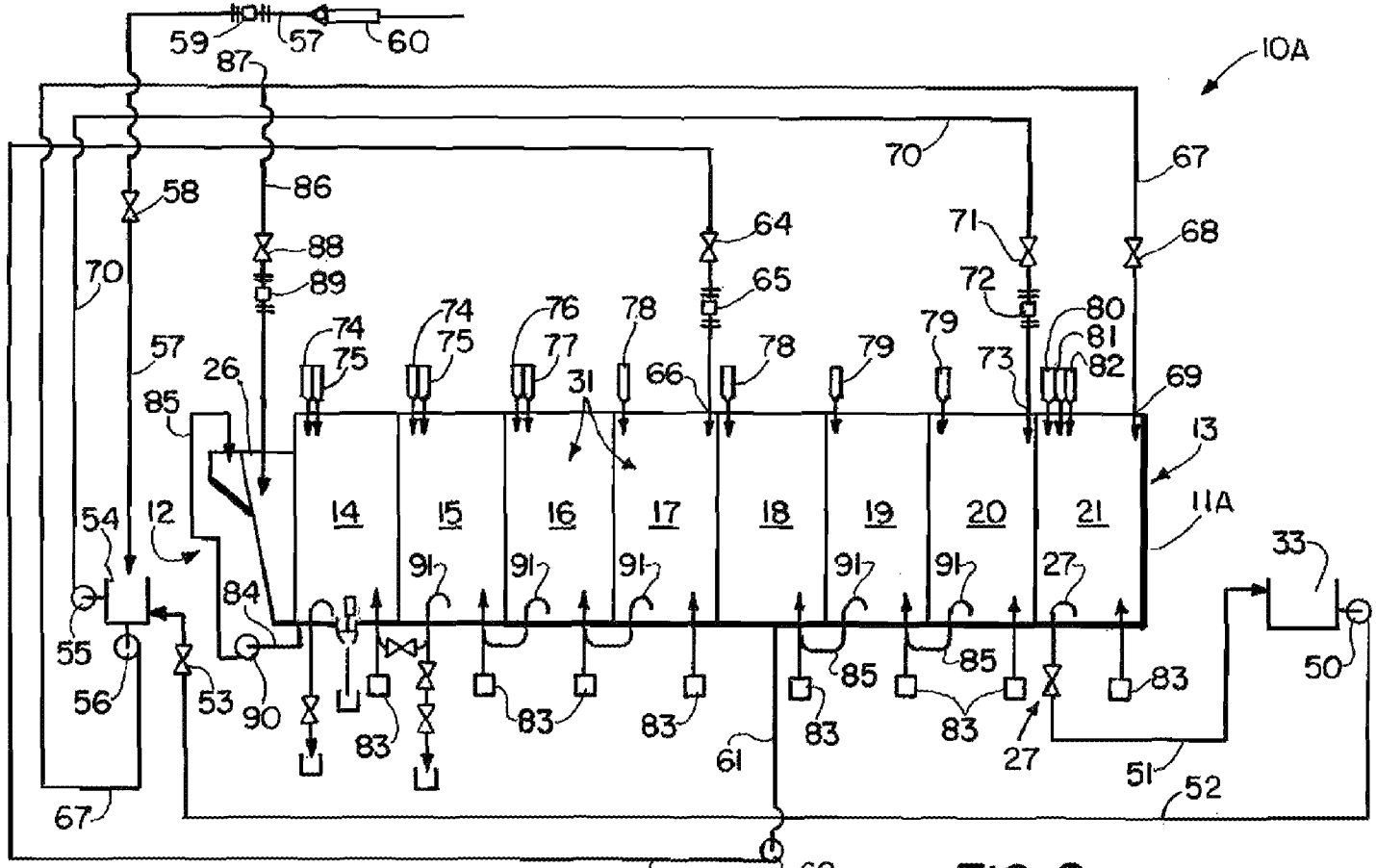
FIG. 2 is a schematic diagram showing a second embodiment of the apparatus of the present invention.

FIGS. 1 and 2 show first and second embodiments of the apparatus of the present invention illustrated generally by the numerals 10 (FIG. 1) and 10A (FIG. 2). FIGS. 1-2 also illustrate embodiments of the method of washing fabric articles in a continuous batch tunnel washer. Textile washing apparatus 10, 10A each provide tunnel washer 11 or 11A having inlet end portion 12 and outlet end portion 13. Tunnel washer 11 interior 31 is divided into sections or modules. These modules can include modules 14-25 (FIG. 1). These modules can include additional modules or fewer modules such as modules 14-21 of FIG. 2.

In FIG. 1, water extracting device 30 (e.g., press or centrifuge) is positioned next to discharge 27. The extraction device 30 is used to remove excess water or extracted water from the fabric articles after they have been discharged from the tunnel washer 11 and placed within the extractor 30. Extraction devices 30 are commercially available. An extraction device 30 could be used with the embodiments of FIG. 1 or 2.

The modules 14-25 in FIG. 1 or the modules 14-21 of FIG. 2 can include dual use modules. If a module is a dual use module, it is used for both standing bath washing and counterflow rinsing. The modules 14-25 can thus include pre-wash modules, main wash modules, and rinse modules, with some modules being dual wash modules. For example, modules 14-24 can be dual use modules in FIG. 1. Modules 14-20 can be dual use modules in FIG. 2.

When functioning as a main wash or standing bath, counterflow via lines 28, 36 can be slowed or halted for a time. Then, counterflow resumes during rinsing. In FIG. 1, a fresh water storage tank 29 can provide fresh water via flow line 38. Module 25 can be injected with a selected sour solution and/or a selected finishing solution that is delivered via inflow line 32. Flow line 32 transmits the sour solution and/or finishing solution from tank 37 to module 25. Finishing solutions can be any desired or known finishing solution, for example a starch solution or an antimold agent.

An extracted water tank 33 can be positioned to receive extracted water from an extraction device 30. Flow line 34 is a flow line that transfers water from extraction device 30 to tank 33. Water contained in tank 33 can be recycled via flow lines 35 or 36. A sour or finishing solution can be injected at module 25 via inflow tank 37. Fresh water can be added to tank 33 via freshwater inflow line 38. Flow line 35 is a recirculation line having pump 39 that transfers extracted water from tank 33 to hopper 26. Another recirculation flow line is flow line 36. The flow line 36 transfers extracted water from tank 33 to flow line 28 and then to interior 31 of tunnel washer 11, beginning at module 24 and then by counterflow to modules 23, 22, 21, 20, 19, 18, 17, 16, 15 in sequence.

For the continuous batch washing apparatus 10 of FIG. 1, twelve modules are shown as an example. The modules 14, 25 can have a temperature of around 40 degrees Celsius. The modules 15, 16 can have a temperature of around 70 degrees Celsius. The module 19 can have a temperature of around 50 degrees Celsius.

In the example of FIG. 1, each of the modules 14-24 can be dual use modules. In FIG. 1, each of the modules 14-24 could thus be part of both a wash function and then a rinse function. In FIG. 1, rinse liquid counterflows via flow line 28 to module 24, then to module 23, then to module 22.

The flow lines 35 and 36 can be provided with pumps in order to boost pressure in those flow lines. Pump 39 is provided in flow line 35 for transmitting water to hopper 26 via flow line 35. Pump 40 is provided in flow line 36 for transmitting water to tank 37 or flow line 28 for counterflow rinsing.

The flow line 36 splits at tee fitting 47 into flow line 28 and flow line 32. The flow line 32 is a flow line that carries re-circulated extracted water from tank 33 to tank 37. Inflow tank 37 can be used to supply sour or finishing chemicals via flow line 32 to the final module 25, which can be a finish module.

Flow line 28 is a re-circulation flow line that enters module 24 and then flows water in counterflow to modules 23, 22 in sequence. A booster pump 41 receives flow from flow line 28. The booster pump 41 then discharges its flow via flow line 43 to module 21. Flow then transfers from module 21 to module 20 then to module 19 and then to module 18 where it transfers via flow line 43 to booster pump 42. Booster pump 42 then discharges its counter flowing rinsing fluid via flow line 44 to module 17 and then to module 16 and then to module 15. At module 15, the rinsing fluid can be discharged via discharge valve 45. A discharge valve 46 can also be provided for module 14. The booster pumps 41, 42 ensure that counter flowing rinsing fluid is maintained at a selected flow rate, flow volume and flow pressure. The booster pumps 41, 42 ensure that a desired pressure head is maintained.

In the example of Table 1 below, a batch size can be between about fifty (50) and three hundred (300) pounds (23-136 kg) of fabric articles, lines or textiles. Total water consumption could be about 0.62 gallons per pound (5.1 liters/kg) of cotton textile fabric articles. Total water consumption could be about 0.64 gallons per pound (5.3 liters/kg) for poly cotton fabric articles.

FIG. 2 shows a second or alternate embodiment of the apparatus of the present invention, designated generally by the numeral 10A. Textile washing apparatus 10A in FIG. 2 is an eight module machine, providing modules 14, 15, 16, 17, 18, 19, 20, and 21. As with the preferred embodiment of FIG. 1, the textile washing apparatus 10A provides a tunnel washer 11A having an inlet end portion 12 and an outlet end portion 13. The outlet end portion 13 can provide a water extraction device 30, not shown in FIG. 2 for purposes of clarity.

Inlet end portion 12 provides hopper 26 for enabling fabric articles such as linen articles to be added to the interior 31 of tunnel washer 11A. A discharge 27 receives effluent from the last or final module 21 where it enters an extractor 30 (not shown). Fluid is then discharged via flow line 51 for collection and extracted water tank 33. Pump 50 receives flow from extracted water tank 33. Pump 50 then transfers fluids from extracted water tank 33 to pulse flow tank 54. A valve 53 can be provided in flow line 52. Pump 55 can be a variable speed pump that transfers fluid from pulse flow tank 54 to flow line 70 and then to module 20. Flow line 70 can be provided with valve 71 and flow meter 72. Line 70 discharges at flow line discharge 73 into module 20.

Pump 56 transmits fluid from pulse flow tank 54 to flow line 67 and then to final module 21. The flow line 67 can be provided with a tee fitting 87. Flow line 67 discharges at flow line discharge 69 into module 21. Flow line 67 can be provided with valve 68. Flow line 86 communicates with flow line 67 at tee fitting 87. Flow line 86 can be provided with valve 88 and flow meter 89. The flow line 86 discharges into hopper 26 as shown in FIG. 2.

Pulse flow tank 54 can receive make up water from flow line 57. Flow line 57 can be valved with valve 58 to receive influent water from a user's water supply. Flow line 57 can be provided with flow meter 59. Flow line 57 can also be provided with a back flow preventer or check valve 60.

Pump 62 can be a variable speed pump. Pump 62 receives flow from module 18 through suction line 61. Pump 62 then transmits fluid through flow line 63 to module 17 at flow line discharge 66. Flow line 63 can be provided with valve 64 and flow meter 65.

A number of chemical injectors or chemical inlets 74-82 can be provided for transmitting a selected chemical into a selected module of the modules 14-21. Examples are shown in FIG. 2. Module 14 has a chemical inlet 74 for adding or injecting alkali. Module 14 is also provided with a chemical inlet 75 for adding or injecting detergent. Similarly, chemical inlets 74 and 75 are provided on module 15. Module 16 is provided with chemical inlet 76 and 77 which enables injection or addition of peracetic acid and peroxide respectively. Modules 17 and 18 can be fitted with chemical inlets 78 for the addition or injection of bleach. Modules 19 and 20 are fitted with chemical inlet 79 that can be used to inject any selected chemical. Module 21 is a final module that can receive finishing chemicals such as a sour, softener, and bacteriostat. The chemical inlet 80 designates sour injection. The chemical inlet 81 designates softener injection. The chemical inlet 82 can be for injecting a bacteriostat. Multiple steam inlets 83 can be provided as shown in FIG. 2. In FIG. 2, a steam inlet 83 is provided for each of the modules 14-21.

Flow line 84 receives flow from module 14. Pump 90 then pumps flow received from flow line 84 into flow line 85 which then discharges into hopper 26 as shown in FIG. 2. A flush zone is thus created in hopper 26 by water entering the hopper 26 from flow line 85 as well as water entering hopper 26 from flow line 86 as shown in FIG. 2. The effect of these flow lines 85, 86 is to transform the hopper 26 and first module 14 into a process area where fabric articles, linen or fabrics are quickly wetted and initially cleaned. A flow line 91 can be provided for counterflow of one module (e.g. module 20) to the previous module (e.g. module 19). Flow lines 91 can be provided for each module 15, 16, 17, 18, 19, 20 as seen in FIG. 2.

Table 1 show examples of water flow rates (in gallons per minute and liters per minute) for light soil and heavy soil for either embodiment (FIG. 1 or FIG. 2). Water flow time (examples) are shown in seconds. Exemplary weights (linen) are shown in pounds and in kilograms. Fresh water consumption is shown for light soil linen in gallons per pound (e.g., 0.1-0.8 gallons per pound) and liters per kilogram (e.g., 1.7-6.7 liters per kilogram for heavy soil linen).

TABLE 1

Water Volumes

| | | Linen Classification | | | |
|---|---|---|---|---|---|
| | | Light Soil | | Heavy Soil | |
| | | GPM | LPM | GPM | LPM |
| Water Flow Rate | Minimum | 25 | 95 | 50 | 190 |
| | Middle | 105 | 398 | 120 | 455 |
| | Maximum | 220 | 833 | 220 | 833 |
| | | Seconds | | Seconds | |
| Water Flow Time | Minimum | 10 | | 10 | |
| | Middle | 30 | | 30 | |
| | Maximum | 360 | | 360 | |
| | | Pounds | KG | Pounds | KG |
| Linen Weight | Minimum | 50 | 23 | 50 | 23 |
| | Middle | 110 | 50 | 110 | 50 |
| | Maximum | 300 | 137 | 300 | 137 |
| | | Gal/Lb | L/Kg | Gal/Lb | L/Kg |
| Fresh Water Consumption | Minimum | 0.1 | 0.8 | 0.2 | 1.7 |
| | Middle | 0.3 | 2.5 | 0.4 | 3.3 |
| | Maximum | 0.8 | 6.7 | 0.8 | 6.7 |

Figure 3:
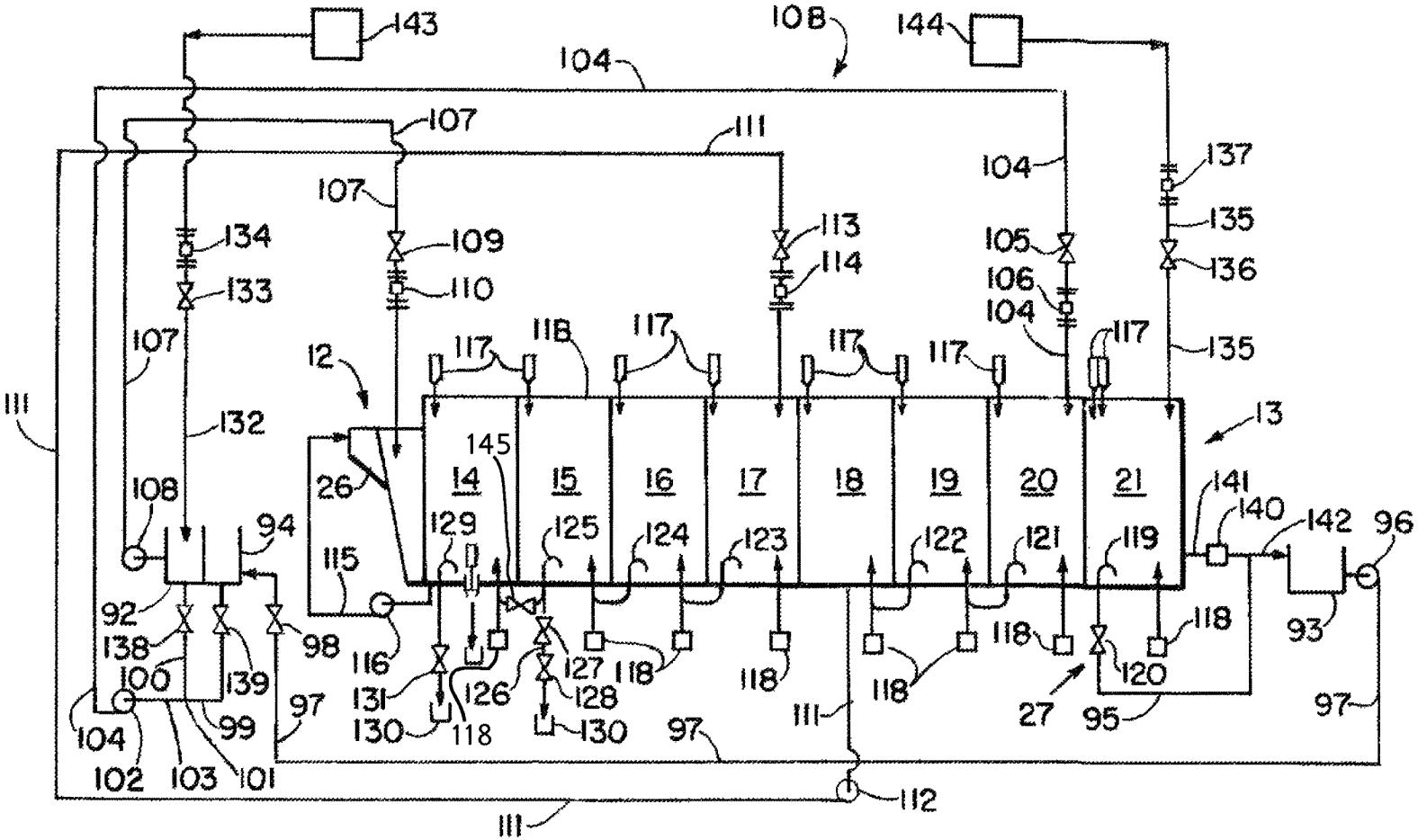
FIG. 3 is a schematic diagram showing a third embodiment of the apparatus of the present invention.

FIG. 3 shows a third embodiment of the apparatus of the present invention designated generally by the numeral 10B. In FIG. 3, there can be seen a tunnel washer 11B having an inlet end portion 12 and an outlet or discharge end portion 13. The tunnel washer 11B has an intake hopper 26. The tunnel washer 11B can have a plurality of modules such as eight modules shown in FIG. 3 and referenced by the numerals 14, 15, 16, 17, 18, 19, 20, and 21.

Fresh water tank 92 can be positioned next to reuse water tank 94. Another tank that is provided is an extracted water tank 93 that receives water from an extractor 140 (e.g., press or centrifuge). Extractor 140 can be used to remove water from fabric articles, linen, or clothing or other items to be cleaned and after discharge from final module 21. Such extractors are commercially available and well-known in the art. Pump 96 discharges fluid from extracted water tank 93 into flow line 97. The flow line 97 can be provided with a valve 98. The flow line 97 discharges into reuse tank 94 as shown.

Flow line 99 is a discharge flow that discharges fluid from reuse tank 94. Flow line 99 can have valve 139. Flow line 100 is a flow line that discharges water from fresh water tank 92. Flow line 100 can have valve 138. A tee fitting 101 is provided for joining line 99 into line 100. The flow line 103 is downstream of tee fitting 101 and communicates with variable speed pump or pump 102. The pump 102 discharges fluid into flow line 104 which discharges into module 20. Flow line 104 can be provided with a valve 105 and flow meter 106.

In various embodiments, counterflow rinsing first uses the extracted water from tanks 93 and 94 followed by clean water from tank 92. Flow line 107 is a flow line that receives fresh water from tank 92 and pump 108. The flow line 107 discharges into hopper 26. The flow line 107 can be provided with valve 109 and flow meter 110. Flow line 111 is a flow line that produces counterflow from module 18 to module 17. The flow in line 111 is boosted (i.e., increased pressure or head) by pump 112 which can be a variable speed pump. The line 111 has valve 113 and flow meter 114. By providing the pump 112, increased flow rate or pressure or increased head can be provided to the counter current or counter flow which begins at module 20 and then progresses to module 19, then to module 18, then to module 17, then to module 16, then to module 15, then to module 14. Flow line 115 is a flow line that conveys fluid from module 14 to hopper 26. Pump 116 can be provided in flow line 115.

Counterflow rinsing begins at module 20, then to module 19 and then to module 18. A pressure drop can occur from module 20 to module 18. Thus, pressure for counterflow rinsing is increased by pump 112 which transfers counterflow rinse from module 18 to module 17 via flow line 111.

A plurality of chemical inlets 117 can be provided, preferably one or more for each module 14-21 as shown. Additionally, steam inlets 118 can be provided for heat transfer, preferably one for each module 14-21 as shown. Steam inlets 118 can discharge into counterflow lines 121-125 for each module 14-21. Module 21 provides a drain 119. Flow line 95 has valve 120 for transferring fluid from module 21 to extracted water tank 93. Arrow 141 schematically illustrates transfer of articles from module 21 to extractor 140. Line 142 is a flow line for carrying extracted water from extractor 140 to extracted water tank 93.

In FIG. 3, there are a number of counterflow lines 121-125. The counterflow line 121 enables counter flow of rinse fluid from module 20 to module 19. The counterflow line 122 enables counter flow of rinse fluid from module 19 to module 18. The counterflow line 123 enables counter flow of rinse fluid from module 17 to module 16. The counterflow line 124 enables counter flow of rinse fluid from module 16 to module 15. The counterflow line 125 enables counter flow of rinse fluid from module 15 to module 14. A drain line 126 and valve 127 are provided for draining fluid from module 15 and for transferring that drain fluid to a sewer 130. Drain line 126 can also be provided with valve 128. Counterflow line 125 can be provided with valve 145. When valve 145 is closed, fluid can drain from module 15 to sewer 130. When valve 145 is open, counterflow line 125 enables counter flow of rinse fluid from module 15 to module 14.

Drain line 129 enables draining of fluid from module 14. The drain line 129 can be provided with valve 131. The drain line 129 can be used to drain fluid from module 14 into a sewer 130. Flow line 132 enables fresh water to be added to fresh water tank 92 from fresh water source 143. The flow line 132 can be provided with valve 133 and flow meter 134. The flow line 135 enables fresh water from source 144 to be added to the final module 21. The flow line 135 can be provided with valve 136 and flow meter 137. Line 135 enables flow of fresh water from source 144 to module 21.

The following is a list of parts and materials suitable for use in the present invention.

PARTS LIST

| Part Number | Description |
|---|---|
| 10 | textile washing apparatus |
| 10A | textile washing apparatus |
| 10B | textile washing apparatus |
| 11 | tunnel washer |
| 11A | tunnel washer |
| 11B | tunnel washer |
| 12 | inlet end portion |
| 13 | outlet end portion |
| 14 | module |
| 15 | module |
| 16 | module |
| 17 | module |
| 18 | module |
| 19 | module |
| 20 | module |
| 21 | module |
| 22 | module |
| 23 | module |
| 24 | module |
| 25 | module |
| 26 | hopper |
| 27 | discharge |
| 28 | flow line |
| 29 | fresh water tank |
| 30 | water extraction device |
| 31 | interior |
| 32 | flow line |
| 33 | tank, extracted water tank |
| 34 | flow line |
| 35 | flow line |
| 36 | flow line |
| 37 | inflow tank |
| 38 | freshwater flow line |
| 39 | pump |
| 40 | pump |
| 41 | booster pump |
| 42 | booster pump |
| 43 | flow line |
| 44 | flow line |
| 45 | valve |
| 46 | valve |
| 47 | tee fitting |
| 50 | pump |
| 51 | flow line |
| 52 | flow line |
| 53 | valve |
| 54 | pulse flow tank |
| 55 | pump |
| 56 | pump |
| 57 | flow line |
| 58 | valve |
| 59 | flow meter |
| 60 | back flow preventer/check valve |
| 61 | suction line |
| 62 | pump |
| 63 | flow line |
| 64 | valve |
| 65 | flow meter |
| 66 | flow line discharge |
| 67 | flow line |
| 68 | valve |
| 69 | flow line discharge |
| 70 | flow line |
| 71 | valve |
| 72 | flow meter |
| 73 | flow line discharge |
| 74 | chemical inlet (alkali) |
| 75 | chemical inlet (detergent) |
| 76 | chemical inlet (peracetic acid) |
| 77 | chemical inlet (peroxide) |
| 78 | chemical inlet (bleach) |

-continued

| PARTS LIST | |
|---|---|
| Part Number | Description |
| 79 | chemical inlet |
| 80 | chemical inlet (sour) |
| 81 | chemical inlet (softener) |
| 82 | chemical inlet (bacteriostat) |
| 83 | steam inlet |
| 84 | flow line |
| 85 | flow line |
| 86 | flow line |
| 87 | tee fitting |
| 88 | valve |
| 89 | flow meter |
| 90 | pump |
| 91 | flow line |
| 92 | fresh water tank |
| 93 | extracted water tank |
| 94 | reuse water tank |
| 95 | flow line |
| 96 | pump |
| 97 | flow line |
| 98 | valve |
| 99 | flow line |
| 100 | flow line |
| 101 | tee fitting |
| 102 | pump/variable speed pump |
| 103 | flow line |
| 104 | flow line |
| 105 | valve |
| 106 | flow meter |
| 107 | flow line |
| 108 | pump |
| 109 | valve |
| 110 | flow meter |
| 111 | flow line |
| 112 | pump/variable speed pump |
| 113 | valve |
| 114 | flow meter |
| 115 | flow line |
| 116 | pump |
| 117 | chemical inlet |
| 118 | steam inlet |
| 119 | drain |
| 120 | valve |
| 121 | counterflow line |
| 122 | counterflow line |
| 123 | counterflow line |
| 124 | counterflow line |
| 125 | counterflow line |
| 126 | drain line |
| 127 | valve |
| 128 | valve |
| 129 | drain line |
| 130 | sewer |
| 131 | valve |
| 132 | flow line |
| 133 | valve |
| 134 | flow meter |
| 135 | flow line |
| 136 | valve |
| 137 | flow meter |
| 138 | valve |
| 139 | valve |
| 140 | extractor |

-continued

| PARTS LIST | |
|---|---|
| Part Number | Description |
| 141 | arrow |
| 142 | flow line |
| 143 | fresh water source |
| 144 | fresh water source |
| 145 | valve |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of washing fabric articles in a continuous batch tunnel washer, comprising the steps of:

a) providing a continuous batch tunnel washer having an interior, an intake, a discharge, and a plurality of modules that segment the interior, the interior including at least one dual use zone that includes multiple of said modules that each function as both a wash module and a rinse module;

b) moving the fabric articles and a volume of liquid in a first direction of travel from the intake to the discharge and through the at least one dual use zone of step "a";

c) washing the fabric articles with a chemical bath in the at least one dual use zone of step "a";

d) after a selected time period rinsing the fabric articles by counter flowing a rinse liquid in the at least one dual use zone of steps "a" and "c" and along a second flow path that is generally opposite the first direction of travel of the fabric articles in step "b";

e) extracting water from the fabric articles after step "d" with an extractor that is downstream of the modules;

f) transmitting the extracted water of step "e" with a first flow line from the extractor of step "e" to a reuse tank; and g) wherein step "d" includes rinsing with a first volume of water from the reuse tank of step "f" followed by a second volume of water that is clean water and not the extracted water from step "e".

2. The method of claim 1, further comprising the step of boosting the flow pressure head of the counter flowing liquid in step "d" at one or more modules.

3. The method of claim 1 wherein in step "d" the counter flow has a duration of between about 2 and 6 minutes.

4. The method of claim 1 wherein the counter flow is at a flow rate of between about 20 and 300 gallons per minute.

5. The method of claim 1 wherein the counter flow is at a flow rate of between about 25 and 220 gallons per minute.

6. The method of claim 1 wherein the counter flow is at a flow rate of between about 35 and 105 gallons per minute.

* * * * *